US009905158B2

(12) United States Patent
Pyeon

(10) Patent No.: US 9,905,158 B2
(45) Date of Patent: Feb. 27, 2018

(54) DISPLAY DEVICE AND POWER CONTROL DEVICE CAPABLE OF PREVENTING THE DEGRADATION OF IMAGE QUALITY

(71) Applicant: LG Display Co., Ltd., Seoul (KR)

(72) Inventor: MyungJin Pyeon, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 176 days.

(21) Appl. No.: 14/855,781

(22) Filed: Sep. 16, 2015

(65) Prior Publication Data

US 2016/0111042 A1 Apr. 21, 2016

(30) Foreign Application Priority Data

Oct. 17, 2014 (KR) ..... 10-2014-0141032

(51) Int. Cl.
*G09G 3/3208* (2016.01)

(52) U.S. Cl.
CPC ... *G09G 3/3208* (2013.01); *G09G 2320/0233* (2013.01); *G09G 2320/045* (2013.01); *G09G 2330/028* (2013.01)

(58) Field of Classification Search
None
See application file for complete search history.

(56) References Cited

U.S. PATENT DOCUMENTS 4,768,015 A * 8/1988 Amano ..... H03M 1/20 348/572
7,167,211 B2 * 1/2007 Kang ..... H03M 1/129 348/571
2005/0007320 A1 1/2005 Smith et al.
2006/0038758 A1 * 2/2006 Routley ..... G09G 3/3233 345/81
2014/0139227 A1 * 5/2014 Iwakiri ..... H05B 33/0815 324/414

FOREIGN PATENT DOCUMENTS

CN 1312535 A 9/2001
CN 1372432 A 10/2002

OTHER PUBLICATIONS

Chinese First Office Action, Chinese Application No. 201510661935.9, dated Oct. 25, 2017, 8 pages.

* cited by examiner

*Primary Examiner* — Chad Dicke
(74) *Attorney, Agent, or Firm* — Fenwick & West LLP

(57) ABSTRACT

A display device and a power control device capable of preventing the degradation of image quality that may occur unexpectedly by performing the sub-pixel luminance deviation compensation. The display device can include an analog-to-digital converter, a timing controller, a power generator, and a power controller, among other components. The power control device can include a power generator and a power controller, among other components.

9 Claims, 13 Drawing Sheets

DISPLAY DEVICE AND POWER CONTROL DEVICE CAPABLE OF PREVENTING THE DEGRADATION OF IMAGE QUALITY

CROSS-REFERENCE TO RELATED APPLICATION

This application claims priority from and the benefit under 35 U.S.C. § 119(a) of Korean Patent Application No. 10-2014-0141032, filed on Oct. 17, 2014, which is hereby incorporated by reference for all purposes as if fully set forth herein.

BACKGROUND OF THE INVENTION

1. Field of the Invention

The present invention relates to a display device and a power control device.

2. Description of the Prior Art

As the information society develops, display devices for displaying an image are being increasingly required in various forms, and in recent years, various display devices such as Liquid Crystal Displays (LCDs), Plasma Display Panels (PDPs), and Organic Light Emitting Display Devices (OLEDs) have been utilized.

The display device includes a display panel, a data drive unit and a gate drive unit. The display panel includes data lines and gate lines, and sub-pixels are defined at each point where the data lines and the gate lines intersect. The display device further includes a data drive unit which provides data signals to the data lines and a gate drive unit which provides scan signals to the gate lines.

A transistor is disposed at each sub-pixel defined in the display panel, and a unique characteristic value such as the threshold voltage, mobility, or the like of the transistor in each sub-pixel may change according to the drive time or the unique characteristic value deviation of the transistor between sub-pixels may occur. In another case, when the display device is an organic light emitting display device, the deviation of the degradation of the organic Light Emitting Diode (OLED) in each sub-pixel may occur. This phenomenon may generate a luminance deviation between each of the sub-pixels, thereby decreasing image quality.

Thus, in order to compensate for a luminance deviation between each of the sub-pixels, a compensation technique is proposed for compensating for the changes or deviations of the characteristic values of the circuit elements (e.g., transistors, organic light emitting diodes).

This sub-pixel luminance deviation compensation senses a voltage at a particular node of a circuit in the sub-pixel, converts the sensed voltage to a digital value and generates sensing data, and then calculates the data compensation amount of data to be supplied to each sub-pixel based on the generated sensing data, and changes the data according to the compensation amount of the calculated data and then supplies the changed data to each sub-pixel, thereby performing sub-pixel luminance deviation compensation.

However, sub-pixel luminance deviation compensation causes an unexpected decrease in image quality, such as by creating a block dim phenomenon along the vertical direction.

SUMMARY OF THE INVENTION

The purpose of embodiments of the present invention is to raise a question of and to provide a solution for a phenomenon of an unexpected decrease in image quality, such as a block dim phenomenon that may occur along the vertical direction, as the sub-pixel luminance deviation compensation is in progress since the sensing reference power, which serves as a reference for converting the sensed analog voltage value into a digital value, fluctuates when generating the sensing data as a basis for the sub-pixel luminance deviation compensation.

Another purpose of the embodiments of the present invention is to provide a display device and a power control device capable of preventing the degradation of image quality that may occur unexpectedly by performing the sub-pixel luminance deviation compensation.

Another purpose of the embodiments of the present invention is to provide a display device and a power control device capable of acquiring accurate sensing data by exactly generating and providing sensing reference power which serves as a reference when converting analog voltage values sensed at the sub-pixels into digital values as required and thereby enabling an accurate sub-pixel luminance deviation compensation to be performed accordingly.

According to an embodiment, a display device is provided, the display device including: an analog-to-digital converter that is connected to a sensing line connected to a sensing node within a sub-pixel on a display panel and converts a voltage at the sensing node sensed via a sensing line into a digital value with reference to the voltage of the sensing reference power to output sensing data; a timing controller that is connected to the analog-to-digital converter via a sensing data transmission line, calculates the data compensation amount based on the sensing data that has been input through the sensing data transmission line, and stores the calculated data compensation amount in a memory; a power generator that generates or regenerates the sensing reference power and then outputs the sensing reference power; and a power controller that, when the sensing reference power is input from the power generator, outputs the sensing reference power input from the power generator to the analog-to-digital converter or controls the power generator to regenerate the sensing reference power.

According to another embodiment, a display device is provided, the display device including: an analog-to-digital converter that converts an analog voltage value to a digital value based on a conversion reference voltage; and a power control device that generates the conversion reference voltage and outputs the generated conversion reference voltage to the analog to digital converter, wherein the generated conversion reference voltage is within defined ranges.

Further, according to another embodiment, a power control device is provided, the power control device including: a power generator that generates and outputs a sensing reference power which serves as a reference when an analog-to-digital converter converts a voltage at the sensing node on the display panel into a digital value; and a power controller that outputs a sensing reference power to the analog to digital converter when the voltage of the sensing reference power input from the power generator is within a predetermined voltage range, and controls the power generator to regenerate the sensing reference power when the voltage of the sensing reference power input from the power generator is out of the predetermined voltage range.

According to embodiments of the present invention as described above, a question can be raised about and a solution can be provided for a phenomenon of an unexpected decrease in image quality such as a block dim phenomenon that may occur along the vertical direction as the sub-pixel luminance deviation compensation is in progress since the sensing reference power which serves as a reference for converting the sensed analog voltage value into a digital value fluctuates when generating the sensing data as a basis for the sub-pixel luminance deviation compensation.

Further, according to embodiments of the present invention, a display device and a power control device can be provided which are capable of preventing the degradation of image quality that may occur unexpectedly by performing the sub-pixel luminance deviation compensation.

Furthermore, according to embodiments of the present invention, a display device and a power control device can be provided which are capable of acquiring accurate sensing data by exactly generating and providing, as required, sensing reference power serving as a basis when converting analog voltage values sensed at the sub-pixels into digital values and accordingly, performing accurate sub-pixel luminance deviation compensation.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Figure 1:
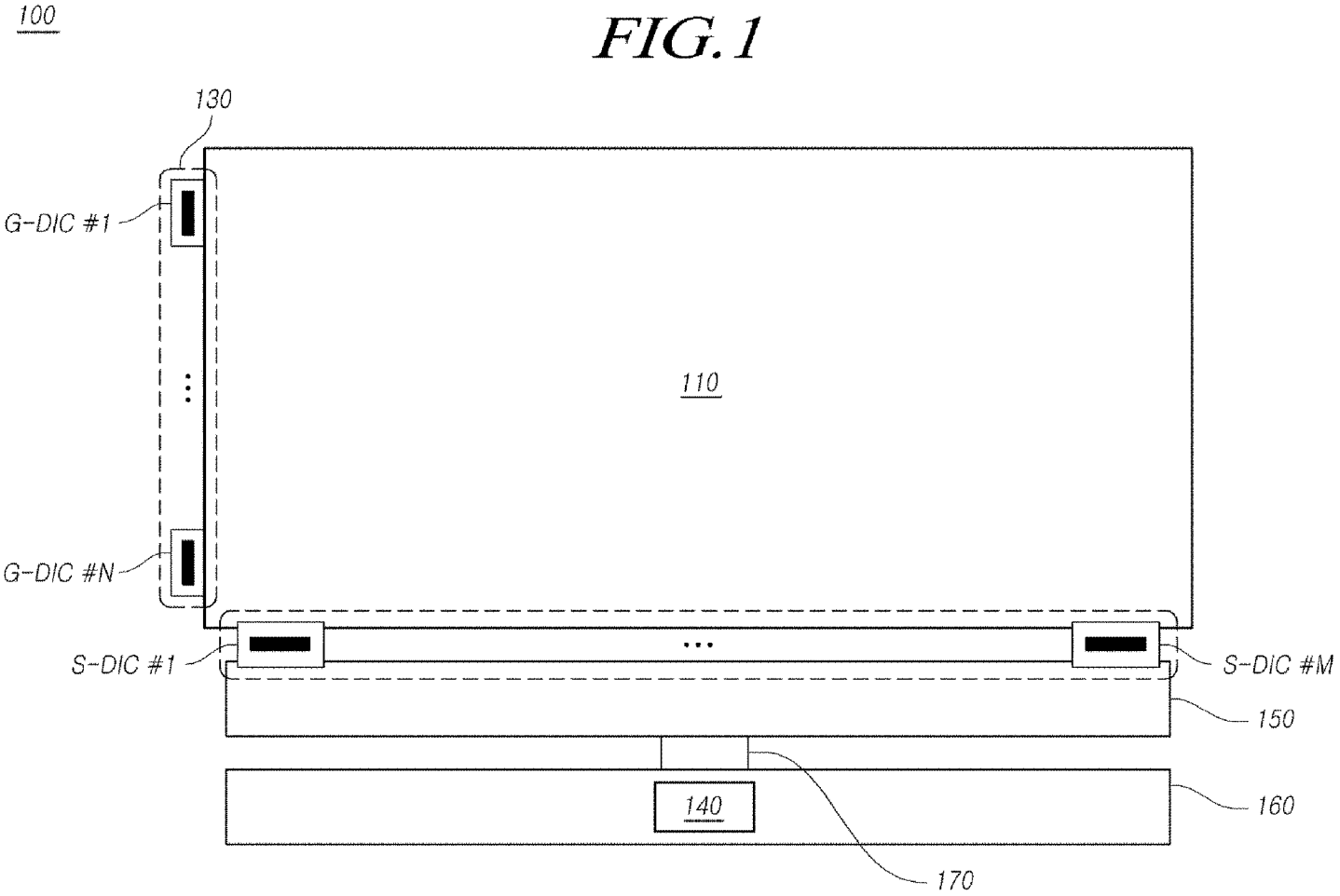
FIG. 1 is a view showing a display device according to embodiments of the present invention.

Hereinafter, embodiments of the present invention will be described with reference to the accompanying drawings. In designating elements of the drawings by reference numerals, the same elements will be designated by the same reference numerals although they are shown in different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. Each of these terminologies is not used to define an essence, order or sequence of a corresponding component but used merely to distinguish the corresponding component from other component(s). In the case that it is described that a certain structural element "is connected to", "is coupled to", or "is in contact with" another structural element, it should be interpreted that another structural element may "be connected to", "be coupled to", or "be in contact with" the structural elements as well as that the certain structural element is directly connected to or is in direct contact with another structural element.

FIG. 1 is a view showing a display device 100 according to embodiments of the present invention.

Referring to FIG. 1, the display device 100 according to the embodiments includes a display panel 110 in which a plurality of data lines and a plurality of gate lines are arranged, a data drive unit 120 for driving a plurality of data lines, a gate drive unit 130 for sequentially driving a plurality of gate lines, and a timing controller 140 for controlling the data drive unit 120 and the gate drive unit 130.

In the display panel 110, sub-pixels are located at every point where a plurality of data lines and a plurality of gate lines cross each other.

The timing controller 140 starts a scan according to a timing implemented in each frame, converts image data input from an interface in correspondence to a data signal form used by the data drive unit 120, outputs the converted image data, and controls a data driving at a proper time in correspondence with the scan.

The timing controller 140 may output various control signals such as a Data Control Signal (DCS), a Gate Control Signal (GCS), and the like, in order to control the data drive unit 120 and the gate drive unit 130.

The gate drive unit 130, based on the control of the timing controller 140, sequentially supplies a scan signal of On-voltage or Off-voltage to a plurality of gate lines and sequentially drives a plurality of gate lines.

The data drive unit 120, based on the control of the timing controller 140, stores the input image data in the memory (not shown), and when a particular gate line is open, the data drive unit 120 converts a corresponding video data (Data) into analog format data voltage (Vdata) and supplies the Vdata to the plurality of data lines and thus drives the plurality of data lines.

Referring to FIG. 1, the data drive unit 120 may include M (1 or more natural number) pieces of source driver integrated circuit (S-DIC: Source Driver IC, it may also be called a data driver integrated circuit (Data Driver IC), S-DIC #1, . . . , a S-DIC #M), and these M source driver integrated circuits (S-DIC #1, . . . , S-DIC # M) may be connected to the bonding pads on the display panel 110 by a tape automated bonding method (TAB) or a chip-on-glass (COG) method or may be formed directly on the display panel 110, and in some cases, these M source drive integrated circuits may be formed by being integrated in the display panel 110.

Referring to FIG. 1, each of the M source driver ICs (S-DIC #1, . . . , S-DIC #M) is implemented by a chip on film (COF) method, and one side and the other side of the source driver IC may be connected to the display panel 110 and the source printed circuit board (S-PCB) 150, respectively.

The gate drive unit 130 may be positioned on only one side of the display panel 110 as illustrated in FIG. 1 or may be divided into two and positioned on both sides of the display panel 110, depending on a driving manner.

Referring to FIG. 1, the gate drive unit 130 may include N (N is a natural number greater than or equal to 2) gate drive integrated circuits (G-DIC: Gate Drive unit IC, G-DIC #1, . . . , G-DIC #N), and such a plurality of gate drive integrated circuits (G-DIC #1, . . . , G-DIC # N) may be connected to the bonding pads on the display panel 110 by a tape automated bonding method (TAB) or a chip-on-glass (COG) method or may be implemented by a Gate In Panel type GIP and formed directly on the display panel 110, and in some cases, the gate driver integrated circuits may be formed by being integrated in the display panel 110.

Referring to FIG. 1, the timing controller 140 may be located on a control printed circuit board 160 connected with a source printed circuit board 150 via a connection means 170 such as a flexible printed circuit (FPC) or a flexible flat cable (FFC) or the like.

The control printed circuit board 160 may further include the power management integrated circuit (PMIC, not shown), a gamma integrated circuit (Gamma IC, not shown) and the like.

The display device 100 schematically illustrated in FIG. 1 may be one among a Liquid Crystal Display (LCD) device, a Plasma Display Panel (PDP) device, an Organic Light Emitting Diode (OLED) display device, etc.

Each of the sub-pixels formed on the aforementioned display panel 110 may include a circuit element such as a transistor, and may further include at least one capacitor, Organic Light Emitting Diode OLED, etc. according to a circuit design method, the type of the display device and the like.

Meanwhile, a plurality of sub-pixels is formed on the display panel 110 and a plurality of pixels P is defined. One pixel P may be configured by, as an example, three sub-pixels (a red sub-pixel, a green sub-pixel, and a blue sub-pixel) or four sub-pixels (a red sub-pixel, a white sub-pixel, a green sub-pixel, and a blue sub-pixel).

Meanwhile, the transistor included in the circuit elements in each sub-pixel has unique characteristic values of a threshold voltage, mobility, etc., and the unique characteristic values are changed depending on driving time. Accordingly, a deviation in the unique characteristic values between each of the transistors may occur. The deviation of the unique characteristic values between transistors in each of the sub-pixels becomes a factor which lowers the quality of the image by generating the luminance deviation between the sub-pixels.

To this end, the display device 100 according to embodiments of the present invention may provide a "compensation function" for compensating for the luminance deviation between the sub-pixels.

The display device 100 according to the embodiment of the present invention includes a structure for sensing unique characteristic values of the transistors included in the circuit in the sub-pixels in order to provide the compensation function.

To this end, for the display panel 110, the "sensing line SL", connected to the circuit in the sub-pixels, may be disposed, one to one, at each column of one sub-pixel or two or more sub-pixels.

These sensing lines may be arranged, as an example, in parallel with the data line.

In addition, one sensing line may also exist for each column of a single sub-pixel, one sensing line may exist for each column of two or more sub-pixels, and one sensing line may exist for each of the pixel columns.

For example, one sensing line may exist for each column of four sub-pixels (a red sub-pixel column, a white sub-pixel column, a green sub-pixel column, and a blue sub-pixel column), that is, one sensing line may exist for each pixel column.

Meanwhile, in order to provide a compensation function, the display device 100 according to an embodiment may include a "sensing unit" that is connected to one or more sensing lines SL and generates sensing data by converting a voltage sensed through the sensing line SL to a digital value, in addition to the configuration of the "sensing line SL", and a "compensation unit" that converts data to be supplied to the sub-pixels for the luminance deviation compensation between the sub-pixels on the basis of the sensing data sensed and output by the sensing unit.

Hereinafter, the above-mentioned sensing unit is also referred to as an analog-to-digital converter (ADC) and is described, for short, as "ADC".

The analog-to-digital converter (ADC) may be located in any place of the display device 100, and as an example, one ADC may be included inside each of the source driver integrated circuits (S-DICs).

Further, the above-mentioned compensation unit may be located in any place inside the display device 100. However, as an example, the compensation unit may be included inside the timing controller 140.

Meanwhile, an analog-to-digital converter (ADC) which corresponds to the sensing unit requires a power serving as a reference when converting the analog voltage values that are sensed via a sensing line SL to digital values. The power required as a reference for the analog to digital conversion may be referred to as "conversion reference power" or "sensing reference power SRP.

The sensing reference power (conversion reference power) may fluctuate due to a variety of noise and another power source or other signals generated inside or outside of the display device 100. That is, a voltage (sensing reference voltage or the conversion reference voltage) of the sensing reference power (conversion reference power) is not fixed and it may momentarily or intermittently vary due to noise, another power source, other signals or the like.

Thus, when the analog-to-digital converter (ADC) converts the sensed analog voltage value to a digital value, if the sensing reference power SRP serving as a reference fluctuates the sensed analog voltage value may be converted to the erroneous digital value and thus an error occurs due to the sensing data.

In this case, since the timing controller 140 corresponding to the compensation unit calculates the data compensation amount based on the erroneous sensing data, an error also occurs due to the calculated data compensation amount. Therefore, since the luminance deviation compensation is not performed suitably in sub-pixel column(s) corresponding to the analog-to-digital converter (ADC) for generating the error from the sensing data, the "block dim phenomenon" may occur along the sub-pixel column direction (e.g., vertical direction).

Thus, the embodiments of the present invention may sense whether the sensing reference power is normal and provides a sensing reference power control function so that the analog-to-digital converter (ADC) may use the normal sensing reference power (conversion reference power).

Hereinafter, a sensing reference power control function according to embodiments of the present invention will be illustrated in more detail.

Figure 2:
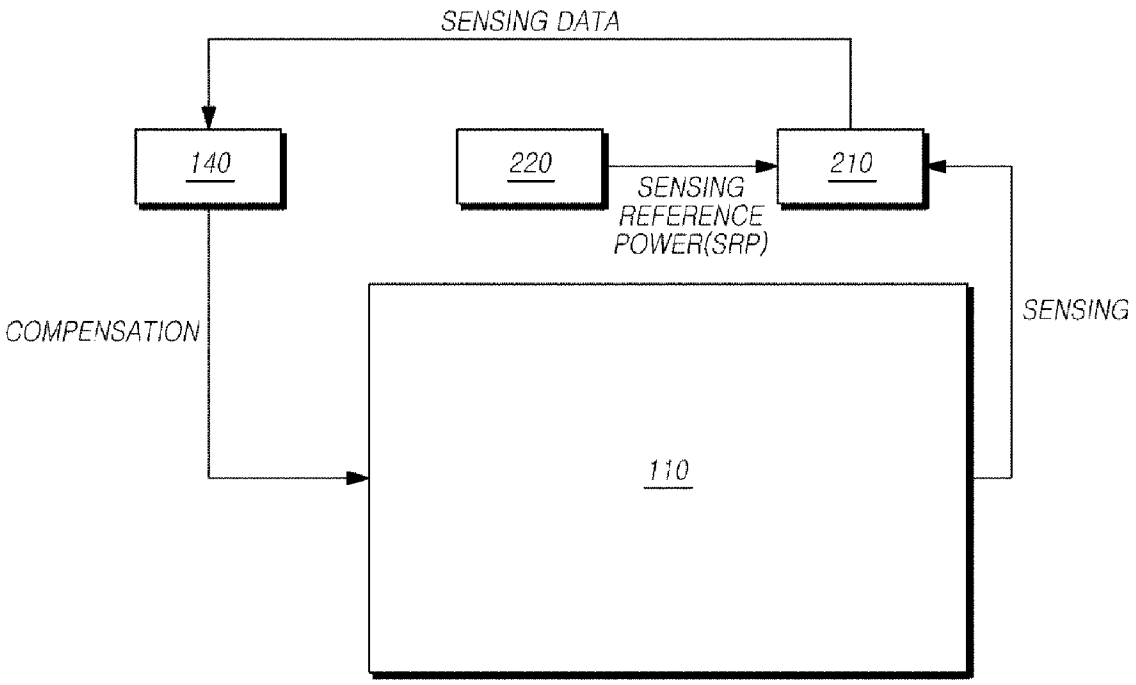
FIG. 2 is a diagram showing a sensing reference power control system in a display device according to embodiments of the present invention.

FIG. 2 is a diagram showing a sensing reference power control system in a display device 100 according to embodiments of the present invention.

Referring to FIG. 2, the sensing reference power control system (or the conversion reference power supply control system) in the display device 100 according to embodiments of the present invention includes an analog-to-digital converter 210 for converting an analog voltage value into a digital value on the basis of the conversion reference voltage (the sensing reference voltage SRP), and a power control device 220 that generates a conversion reference voltage (sensing reference voltage SRP) and outputs the conversion reference voltage (sensing reference voltage SRP) to the analog-to-digital converter 210, wherein the power control device 220 generates a conversion reference power (sensing reference voltage SRP) within a predetermined range (from the minimum voltage to maximum voltage) and outputs the conversion reference power (sensing reference voltage SRP) within the predetermined range to the analog-to-digital converter 210.

According to the above description, the analog-to-digital converter 210, when converting an analog voltage value into a digital value, converts analog voltage values to digital values using the sensing reference power SRP within a predetermined range (the range from the minimum voltage to the maximum voltage) which may ensure conversion accuracy and thus it is possible to improve the accuracy of the analog to digital conversion.

Meanwhile, the conversion reference power control function described above may be applied to other general analog to digital conversions as well as an analog to digital conversion for a compensation function.

Figure 3:
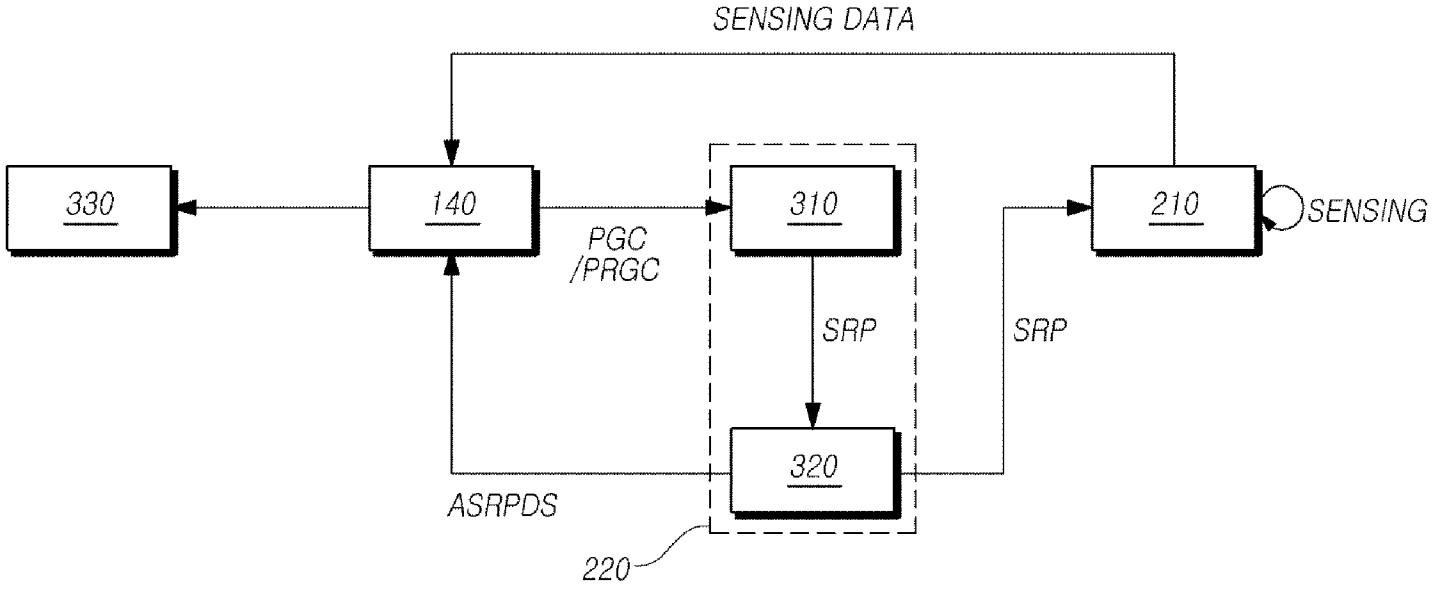
FIGS. 3 to 4 are detailed block diagrams of an electronic control device in a sensing reference power control system in a display device according to embodiments of the present invention.
Figure 4:
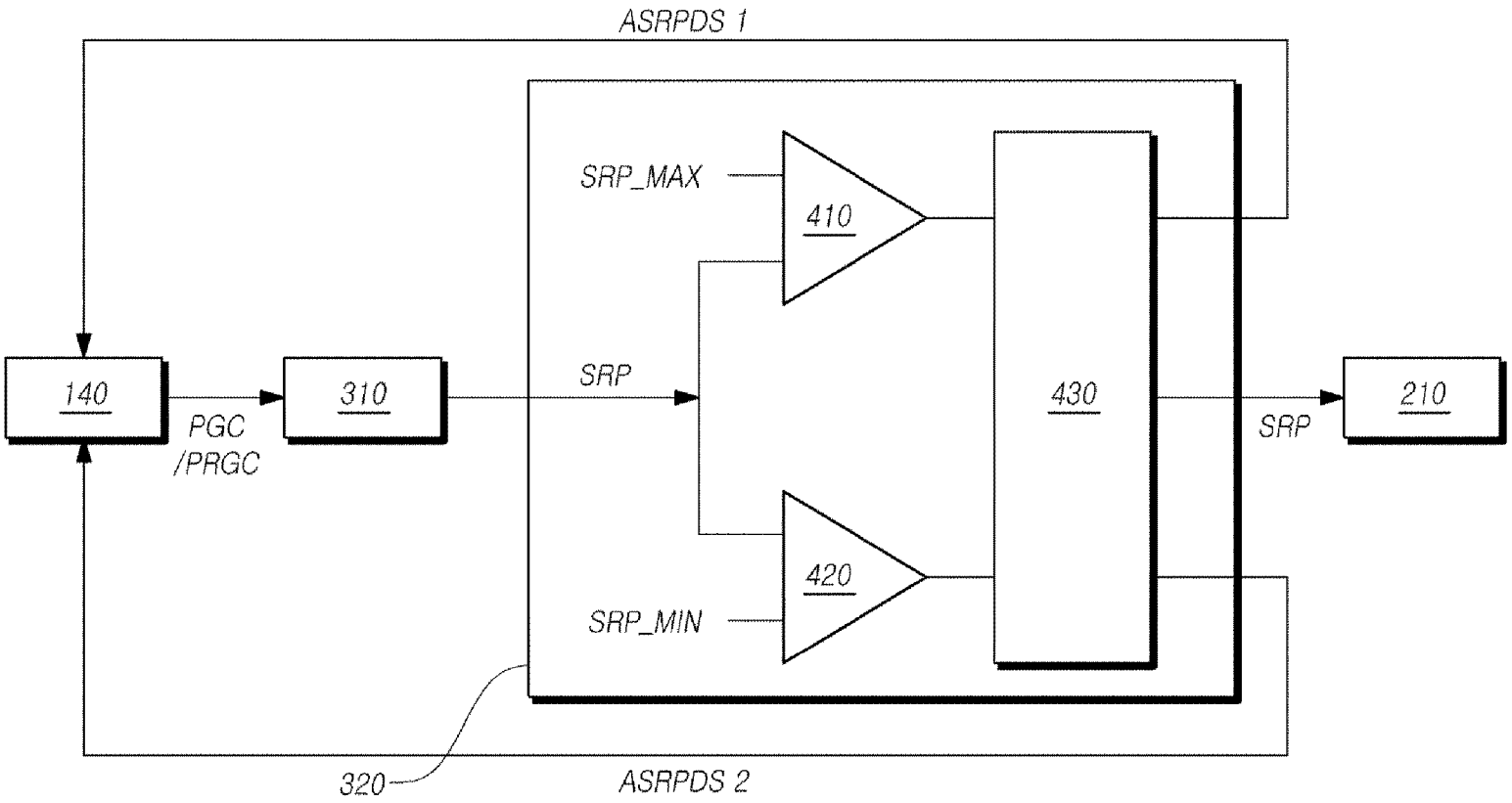

FIGS. 3 to 4 are detailed block diagrams of an electronic control device in a sensing reference power control system in a display device 100 according to embodiments of the present invention.

Referring to FIG. 3, a power control device 220, which generates a sensing reference power SRP within a predetermined range (the range from the minimum voltage to the maximum voltage) and outputs the SRP to the analog-to-digital converter 210, includes a power generator 310, and a power controller 320.

The power generator 310 generates and outputs a sensing reference power SRP which serves as a reference when an analog-to-digital converter 210 converts the voltage at the sensing node (N1 or N4 or any node on the sensing line SL, in FIG. 6) in the sub-pixels on the display panel 110 to a digital value.

The power controller 320 determines whether the voltage (sensing reference voltage) of the sensing reference power SRP input from the power generator 310 is within a predetermined voltage range, and when the voltage (sensing reference voltage) of the sensing reference power SRP input from the power generator 310 is within a predetermined voltage range, the power controller 320 outputs the sensing reference power SRP input from the power generator 310 to the analog-to-digital converter 210, and when the voltage of the sensing reference power input from the power generator 310 is out of the predetermined voltage range, the power controller 320 controls the power generator 310 to regenerate the sensing reference power SRP.

According to the above description, it is possible to provide a mechanism capable of regenerating the sensing reference power SRP and detailed configurations of the power control device 220 therefor so that the analog-to-digital converter 210, when converting an analog voltage value into a digital value, may perform an accurate analog to digital conversion using the sensing reference power SRP within a predetermined range (the range from the minimum voltage to the maximum voltage) guaranteeing conversion accuracy.

Hereinafter, the sensing reference power control system briefly described above will be described in more detail in conjunction with the compensation system.

Referring to FIG. 3, an analog-to-digital converter 210 corresponding to the compensation unit in the compensation system is connected to a sensing line SL connected to the sensing node within the sub-pixel on the display panel 110, and outputs the sensing data after converting the voltage of the sensing node that is sensed through the sensing line SL, based on the voltage of the sensing reference power SRP, to a digital value.

Referring to FIG. 3, the timing controller 140 corresponding to the compensation unit in the compensation system is connected to the analog-to-digital converter 210 through sensing data transmission lines SDTL (shown as Sensing Data in FIG. 3), and calculates a data compensation amount based on the sensing data input through the sensing data transmission line SDTL to store in a memory 330.

Thus, the data compensation amount stored in the memory 330 is utilized when driving a video in the future and the sub-pixel luminance deviation compensation is actually performed.

That is, when transmitting data which will be supplied to each sub-pixel to the source driver integrated circuits (S-DIC #1, . . . , S-DIC #M) in order to drive the video, the timing controller 140 changes the data to be transmitted and transmits the changed data to the source driver integrated circuits (S-DIC #1, . . . , S-DIC #M) with reference to the data compensation amount stored in the memory 330. The source driver ICs (S-DIC #1, . . . , S-DIC #M) converts, using an internal digital to analog converter (DAC, not shown), the data received by itself to an analog data voltage, and outputs the converted data voltage to the corresponding data line. Thus, the luminance deviations of the sub-pixels are compensated for.

Referring to FIG. 3, the power generator 310 generates or regenerates the sensing reference power SRP that serves as a reference when the analog-to-digital converter 210 converts a voltage at the sensing node to a digital value and outputs the generated or regenerated SRP.

Referring to FIG. 3, when the sensing reference power SRP is input from the power generator 310, the power controller 320 outputs the sensing reference power SRP input from the power generator 310 to the analog-to-digital converter 210 or controls the power generator 310 to regenerate the sensing reference power SRP.

According to the above description, it is possible to provide a mechanism capable of regenerating the sensing reference power SRP and a power generator 310 and a power control device 220 therefor so that the analog-to-digital converter 210 may perform, when converting an analog voltage value into a digital value, an accurate analog to digital conversion using the sensing reference power SRP within a predetermined range (the range from the minimum voltage to the maximum voltage) guaranteeing conversion accuracy.

Referring to FIG. 3, the timing controller 140 outputs, according to the sensing timing for the compensation function, the power generation control signal (PGC) that generates the sensing reference power SRP which serves as a reference at the time of sensing.

Accordingly, when a power generation control signal PGC is first input from the timing controller 140, the power generator 310 generates a sensing reference power SRP and outputs the generated SRP to the power controller 320.

The power controller 320 determines whether the voltage of the sensing reference power SRP output from the power generator 310 is within a predetermined voltage range, and determines whether the sensing reference power SRP output from the power generator 310 is normal or abnormal.

Referring to FIG. 3, when the sensing reference power SRP output from the power generator 310 is determined to be normal, the power controller 320 outputs the sensing reference power SRP output from the power generator 310 to the analog-to-digital converter 210, and when the sensing reference power SRP output from the power generator 310 is determined to be abnormal, the power controller 320 outputs an Abnormal SRP Detection Signal ASRPDS meaning that the sensing reference power SRP output from the power generator 310 is abnormal to the timing controller 140.

Referring to FIG. 3, when the Abnormal SRP Detection Signal ASRPDS is received from the power controller 320, the timing controller 140 outputs a power re-generation control signal PRGC to the power generator 310.

Accordingly, when the power re-generation control signal PRGC is input from the timing controller 140, the power generator 310 re-generates the sensing reference power SRP and re-outputs the regenerated SRP to the power controller 320.

By repeating the process as described above, the normal sensing reference power SRP from the power controller 320 is finally transmitted to the analog-to-digital converter 210.

According to the above description, it is possible to provide an efficient signaling system for a re-generation mechanism of the sensing reference power SRP so as to generate the sensing reference power SRP that can become an accurate reference, in order for the analog-to-digital converter 210 to accurately convert an analog voltage value into a digital value, and transmit the generated sensing reference power SRP to the analog-to-digital converter 210.

The above-described power controller 320 determines whether there is an abnormality in the sensing reference power SRP generated by the power generator 310, and determines whether to output to the analog-to-digital converter 210 or determines whether to regenerate the sensing reference power SRP.

Referring to FIG. 4, the power controller 320 will be described in more detail.

Referring to FIG. 4, the power controller 320 includes comparators 310 and 320 for comparing the voltage of the sensing reference power SRP input from the power generator 310 with a predetermined maximum voltage SRP_MAX and minimum voltage SRP_MIN, respectively; and a determination unit 430 for outputting, depending on the result of the comparison, the abnormal sensing reference power detection signal ASRPDS1 or ASRPDS2 to the timing controller 140, when the voltage of the sensing reference power SRP input from the power generator 310 exceeds the maximum voltage SRP_MAX or is less than the minimum voltage SRP_MIN, that is, if the voltage of the sensing reference power input SRP input from the power generator 310 is out of the predetermined voltage range, and outputting the sensing reference power input SRP input from the power generator 310 to the analog-to-digital converter 210, when the voltage of the sensing reference power SRP input from the power generator 310 is greater than or equal to the minimum voltage SRP_MIN or less than or equal to the maximum voltage SRP_MAX, that is, if the voltage of the sensing reference power SRP input from the power generator 310 is within the predetermined voltage range.

Referring to FIG. 4, the timing controller 140 outputs a power regeneration control signal PRGC to the power generator 310 depending on the abnormal sensing reference power detection signal ASRPDS1 or ASRPDS2 output from the determination unit 430 of the power controller 320.

Accordingly, the power generator 310 re-generates and re-outputs the sensing reference power SRP.

According to the above description, it is possible to provide a detailed configuration of the power controller 320 corresponding to the important control structure, which determines whether there is an abnormality in the sensing reference power SRP generated by the power generator 310 and decides whether to output the sensing reference power to the analog-to-digital converter 210 or decides whether to regenerate the sensing reference power, so as to generate the sensing reference power SRP that can become an accurate reference, in order for the analog-to-digital converter 210 to accurately convert an analog voltage value into a digital value, and transmit the sensing reference power SRP to the analog-to-digital converter 210.

Hereinafter, the above-described sensing reference power control method will be briefly described again with reference to FIG. 5.

Figure 5:
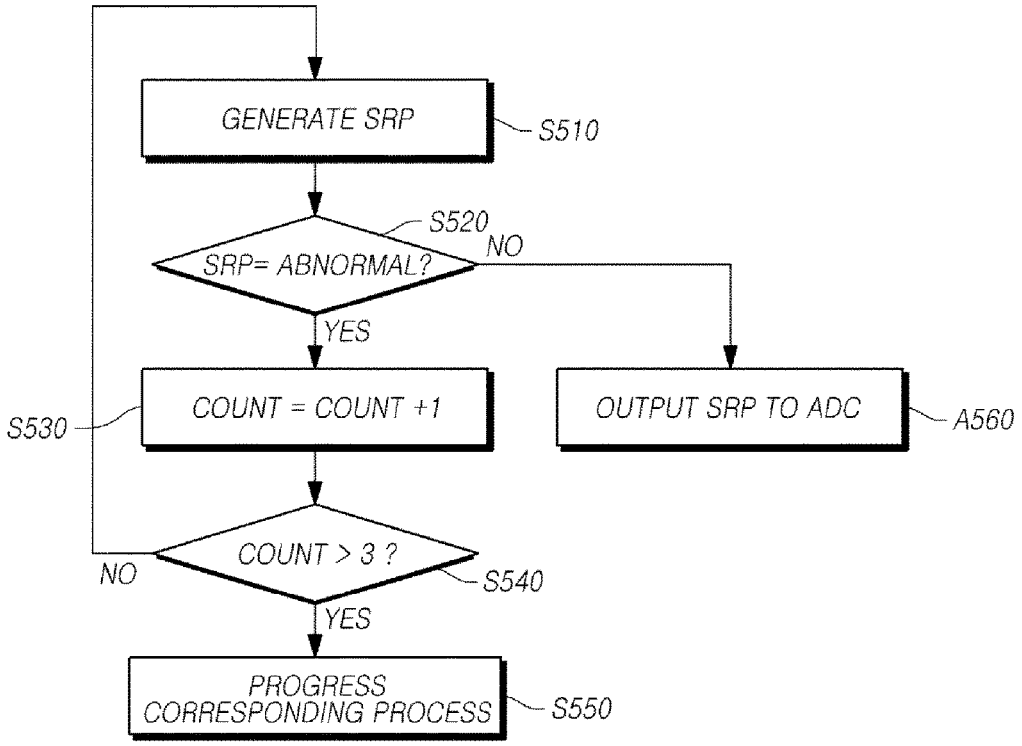
FIG. 5 is a flowchart showing a method of controlling a sensing reference power by a sensing reference power control system in a display device according to embodiments of the present invention.

FIG. 5 is a flowchart showing a method for controlling a sensing reference power SRP by a sensing reference power control system in a display device 100 according to embodiments of the present invention.

Referring to FIG. 5, in step S510, the power generator 310 generates a sensing reference power SRP depending on a power generation control signal PGC input from the timing controller 140.

Hereinafter, in step S520, the power controller 320 determines whether the sensing reference power SRP input from the power generator 310 is abnormal.

As a result of the determination in step S520, when the sensing reference power SRP input from the power generator 310 is determined to be normal, that is, if the sensing reference power SRP input from the power generator 310 is within the normal range (which is greater than or equal to the minimum voltage and less than or equal to the maximum voltage), in step S560, the power controller 320 finally outputs the normal sensing reference signal SRP to the analog-to-digital converter 210.

As a result of the determination in step S520, when the sensing reference power SRP input from the power generator 310 is determined to be abnormal, that is, if the sensing reference power SRP input from the power generator 310 is out of the normal range (the range which exceeds the maximum voltage or is less than the minimum voltage), in step S530, the power controller 320 increases the count value (COUNT) by one. The count value (COUNT) represents the number of times the sensing reference power SRP input from the power generator 310 is determined to be abnormal.

After the S530 step, the power controller 320 determines whether the count value (COUNT) exceeds (or is greater than or equals to) a predetermined threshold count value (e.g., three) in step S540.

Here, the threshold count value (e.g., three) is information on determining whether the corresponding action on the abnormal situations of the sensing reference power SRP is required. The count value (COUNT) increases by zero, one, or two, and when the sensing reference power is determined to be normal, the count value can be reset back to zero.

As a determination result of step S540, when it is determined that the count value (COUNT) is less than or equal to a predetermined threshold count values (e.g., three), that is, if it is determined that the corresponding measurements on the abnormal situations of the sensing reference power SRP are still not necessary, the power controller 320 outputs the abnormal sensing reference power detection signal ASRPDP to the timing controller 140.

The timing controller 140 outputs the power re-generation control signal PRGC to the power generator 310.

Accordingly, the power generator 310 re-generates the sensing reference power SRP in step S510.

Hereinafter, by repeating the process described above, in step S560, the power controller 320 finally outputs the normal sensing reference signal SRP to the analog-to-digital converter 210.

As a determination result of step S540, when it is determined that the count value (COUNT) exceeds a predetermined threshold count values (e.g., three), that is, if it is determined that the corresponding measures on the abnormal situations of the sensing reference power SRP is required, the power controller 320 or the timing controller 140 performs a corresponding process in step S550.

As an example, when the number of times (COUNT) of the abnormal situation occurrence of the sensing reference power SRP input from the power generator 310 is larger than or equal to a predetermined number (a threshold count value, for example, three or four times or possibly larger values than three or four), the power controller 320 or a timing controller 140 may output the control signal for progressing to a power-off process or a display device reset process to the power management unit (not shown).

As described above, when the abnormal situation of the sensing reference power SRP has continuously occurred a predetermined number of times or more, the display device 100 is powered off or reset and thus it is possible to turn the power on and induce the sensing reference power SRP to be under normal situations. These response measures can be adapted to a case where an abnormal situation of the sensing reference power SRP is temporarily or sporadically generated by a signal or a noise.

As another example, when the number of times of the abnormal situation occurrence of the sensing reference power SRP input from the power generator 310 is larger than or equal to a predetermined number (a threshold count value, three or four times or possibly bigger values than 3 or 4), the power controller 320 or the timing controller 140 may stop the compensation process.

As described above, when the abnormal situations of the sensing reference power SRP input from the power generator 310 has continuously occurred a predetermined number of times or more, the power controller 320 or a timing controller 140 may prevent the image quality from being degraded due to the error occurring due to the sensing data by not performing the compensation process using the sensing reference power SRP. The above described measure is a response measure that can be taken when the case of not performing the compensation process is more advantageous in terms of the image quality as compared to the case of obtaining the sensing data using an abnormal sensing reference power and proceeding the compensation process therefrom.

Meanwhile, the number of times that is referenced in order to power off the display device 100 or reset the display device 100 and the number of times that is referenced to determine the timing for stopping the compensation process are the same value but also may be set to be different from each other.

For example, the number of times (a second threshold count value) to be referenced to determine the timing for stopping the compensation process can be set to be larger than the number of times (a first threshold count value) that is referenced in order to determine the timing for cutting off the power supply of the display device 100 or resetting the display device 100.

In other words, when the number of times (COUNT) of the abnormal situation occurrence of the sensing reference power SRP is greater than or equal to (or exceeds) the first threshold count value, the timing controller 140 or the power controller 320 outputs a control signal for cutting-off the power of the display device 100 and resetting the display device 100. At this time, the number of times (COUNT) the abnormal situation of the sensing reference power SRP has occurred is not reset.

The timing controller 140 or the power controller 320 determines, after the display device 100 is powered on again, whether the abnormal situation of the sensing reference power SRP is maintained or has been restored to the normal situation. When it is determined that the occurred abnormal situation of the sensing reference power SRP is still maintained, the timing controller 140 or the power controller 320 may increase, once more, the number of times (COUNT) by which the abnormal situation of the sensing reference power SRP has occurred. Further, when the number of times (COUNT) becomes larger than or equal to (or exceeds) the second threshold count value, the timing controller 140 or the power controller 320 may stop the compensation process.

Thereafter, the timing controller 140 or the power controller 320 may output a control signal to display a message indicating that the display device 100 needs to be repaired.

Each of the steps of the flowchart illustrated in FIG. 5 may be changed, such as modified, integrated or separated within the range that does not change the basic technical concept of the embodiments.

Meanwhile, the sensing reference power control described above is a control of the sensing reference power, which serves as a reference when the analog-to-digital converter 210 senses a voltage at the sensing node within the sub-pixel via a sensing line SL and converts the sensed voltage into a digital value, to have a desired fixed voltage.

In the following, referring to FIGS. 6 and 7, a description will be given on a sub-pixel structure in which sensing is performed by the analog-to-digital converter 210 and a sensing line arrangement structure associated therewith.

However, the display device 100 according to embodiments of the present invention can be a different type such as a liquid crystal display device and an organic light emitting display device, and in the following description, the sub-pixel structure and the sensing line arrangement structure for the organic light emitting display device will be explained as an example.

Figure 6:
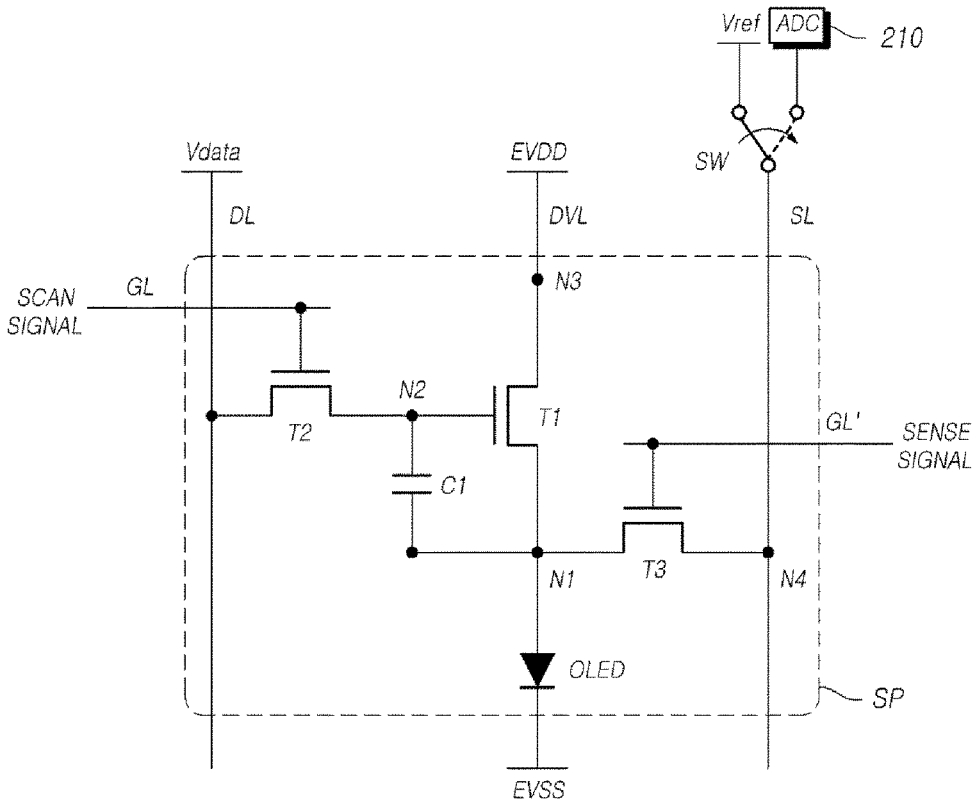
FIG. 6 is a diagram exemplarily indicating a sub-pixel structure of a display device according to embodiments of the present invention.

FIG. 6 is a diagram exemplarily indicating a sub-pixel structure of a display device 100 according to embodiments of the present invention.

Referring to FIG. 6, each of the plurality of sub-pixels arranged on the display panel 110 of the display device 100 according to embodiments of the present invention includes organic light-emitting diodes OLED and circuits for driving the same.

The organic light emitting diode drive circuit within each sub-pixel may include at least one transistor and at least one capacitor. Further, the organic light emitting diode drive circuit in each sub-pixel may further include a circuit element for the luminance deviation compensation.

FIG. 6 is an equivalent circuit diagram for the sub-pixels with 3T (Transistor) 1C (Capacitor) structure including the organic light emitting diode drive circuit, three transistors (T1, T2, T3) and one capacitor C1.

Referring to FIG. 6, the first transistor T1 among the three transistors (T1, T2, T3) is a driving transistor for driving the organic Light Emitting Diode (OLED) and is connected between the driving voltage line DVL or the pattern associated with the driving voltage line DVL and the organic light emitting diode OLED.

Referring to FIG. 6, the second transistor T2 among the three transistors (T1, T2, T3) is a switching transistor which turns on or turns off depending on the presence or absence of a scan signal through the first gate line GL, and when turned-on, turns on or off the first transistor T1 by applying a voltage at a second node N2 (gate node) of the first transistor T1 corresponding to the driving transistor, and the second transistor T2 is connected between the data line DL for supplying a data voltage Vdata and the second node N2 of the first transistor T1.

Referring to FIG. 6, the first node N1 of the first transistor T1 is a drain node or a source node and is a_node connected to the first electrode (e.g., an anode electrode or a cathode electrode) of the organic light emitting diode OLED. Here, the second electrode (e.g., a cathode electrode or an anode electrode) of the organic Light Emitting Diode (OLED) is applied with the base voltage EVSS. The second node N2 of the first transistor T1 is a gate node, and is applied with data voltage Vdata supplied from the data line DL through the turned-on second transistor T2. The third node N3 of the first transistor T1 is a source node or a drain node, and is applied with a driving voltage EVDD supplied from the driving voltage line DVL or the pattern connected thereto.

Referring to the FIG. 6, the third transistor T3 among the three transistors (T1, T2, T3) is connected between a fourth node N4 in which the reference voltage Vref is supplied from the reference voltage line RVL (shown in FIG. 6 as sensing line SL) or a pattern connected thereto and the first node N1 of the first transistor T1.

Here, an end portion of the reference voltage line RVL which is electrically connected with the fourth node N4 is connected to a switch SW. The switch SW selectively connects the reference voltage line RVL to either a supplying point of the reference voltage Vref or the analog-to-digital converter 210.

The third transistor T3 is a sensing transistor that is involved in compensating for the luminance deviation of the sub-pixel, and is turned on or turned off depending on whether a sense signal that is a kind of scan signal from the second gate line GL' is supplied or not, and when turned-on, the third transistor T3 serves to apply the reference voltage Vref to the first node N1 of the first transistor T1 or serves to have the voltage at the first node N1 of the first transistor T1 sensed by the analog-to-digital converter 210 through the reference voltage line RVL. Here, the reference voltage line RVL corresponds to the sensing line SL.

The analog-to-digital converter 210 senses the voltage at the sensing node based on the sensing reference power SRP and converts the sensed voltage to a digital value to generate sensing data, and transmits the generated sensing data to the timing controller 140.

Here, the sensing node at which the voltage is sensed by the analog-to-digital converter 210 may be any node (including N4) on the sensing line SL, and may be the first node N1 of the first transistor T1 when the third transistor T3 is turned on at the voltage sensing time point.

Further, the voltage sensed by the analog-to-digital converter 210 is a voltage for identifying unique characteristic values of the sub-pixels SP or the change (deviation) of the unique characteristic values.

Here, the unique characteristic value for the sub-pixels SP corresponds to, as an example, the unique characteristic value (the threshold voltage or mobility) of the first transistor T1 which is the drive transistor within the sub-pixel SP, or corresponds to the unique characteristic value (the threshold voltage) of the organic light-emitting diode OLED.

The timing controller 140 receives the sensing data, and, on the basis of the sensed data, performs a compensation process which compensates for the deviation on the unique characteristic values (the threshold voltage, mobility, etc.) of the first transistor T1 corresponding to the driving transistor in each sub-pixel, or the unique characteristic values (the threshold voltage, etc.) of the organic light-emitting diode OLED. Here, for the compensation process, the data compensation amount which is compensated for the deviation of the unique characteristic value of the first transistor T1 or the unique characteristic value of the organic Light Emitting Diode (OLED) is determined, and the data which will be supplied to the corresponding sub-pixel is changed depending on the determined data compensation amount and then the changed data is supplied to the source driver 120.

Referring to FIG. 6, one capacitor C1 is connected between the second node N2 and the third node N3 of the first transistor T1 corresponding to the driving transistor, and the capacitor C1 serves to maintain a constant voltage for a certain period of time (for example, a frame time).

Referring to FIG. 6, the change of timing of various signals (EVDD, EVSS, Vdata, Scan Signal, Sense Signal, etc.) necessary to drive the 3T1C structured sub-pixels is controlled by the timing controller 140.

Figure 7:
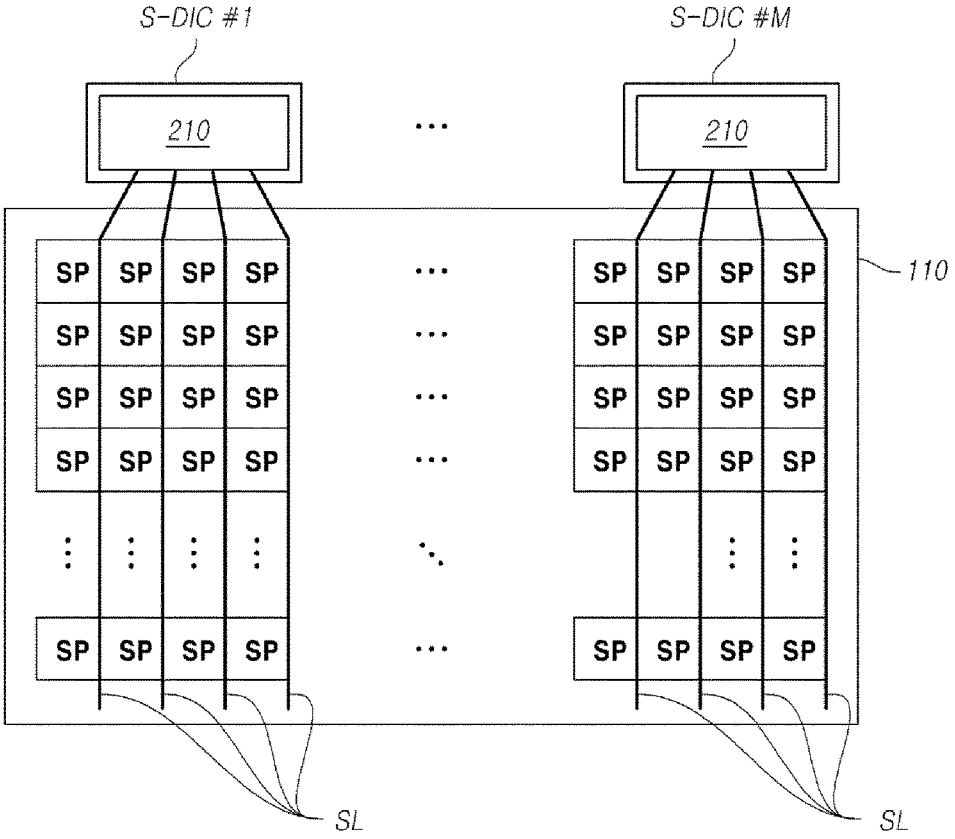
FIGS. 7 and 8 are layout diagrams of an analog-to-digital converter and a sensing line in a display device according to embodiments of the present invention.
Figure 8:
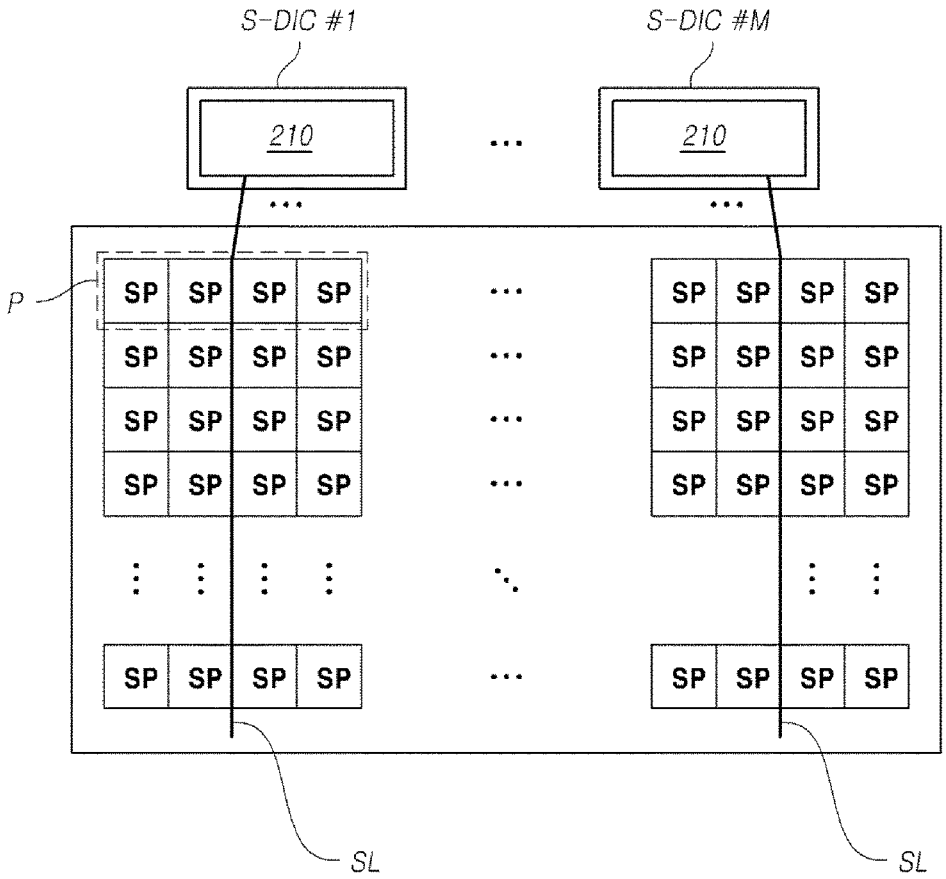

FIGS. 7 and 8 are layout diagrams of an analog-to-digital converter 210 and a sensing line SL in a display device 100 according to embodiments of the present invention.

Referring to FIG. 7, a single sensing line SL may be disposed at each column of one sub-pixel or at each column of two or more sub-pixels.

Alternatively, as shown in FIG. 8, a case is exemplified where one pixel is constituted by four sub-pixels, and one sensing line SL may be disposed at each column of one pixel column. The sensing line SL is connected with the four sub-pixels at the same time.

Referring to FIGS. 7 and 8, one analog-to-digital converter 210 is connected to one or more sensing lines SL and is included in a single source driver IC.

That is, one source driver integrated circuit (S-DIC) may include one analog-to-digital converter 210, and one analog-to-digital converter 210 may include a plurality of channels connected to a plurality of sensing lines SL.

According to the description above, in order to compensate for sub-pixel luminance deviation, it is possible to provide a sensing structure capable of sensing the unique characteristic value of the first transistor T1 corresponding to the driving transistor in each sub-pixel or the unique characteristic value of the organic light emitting diode OLED.

Figure 9:
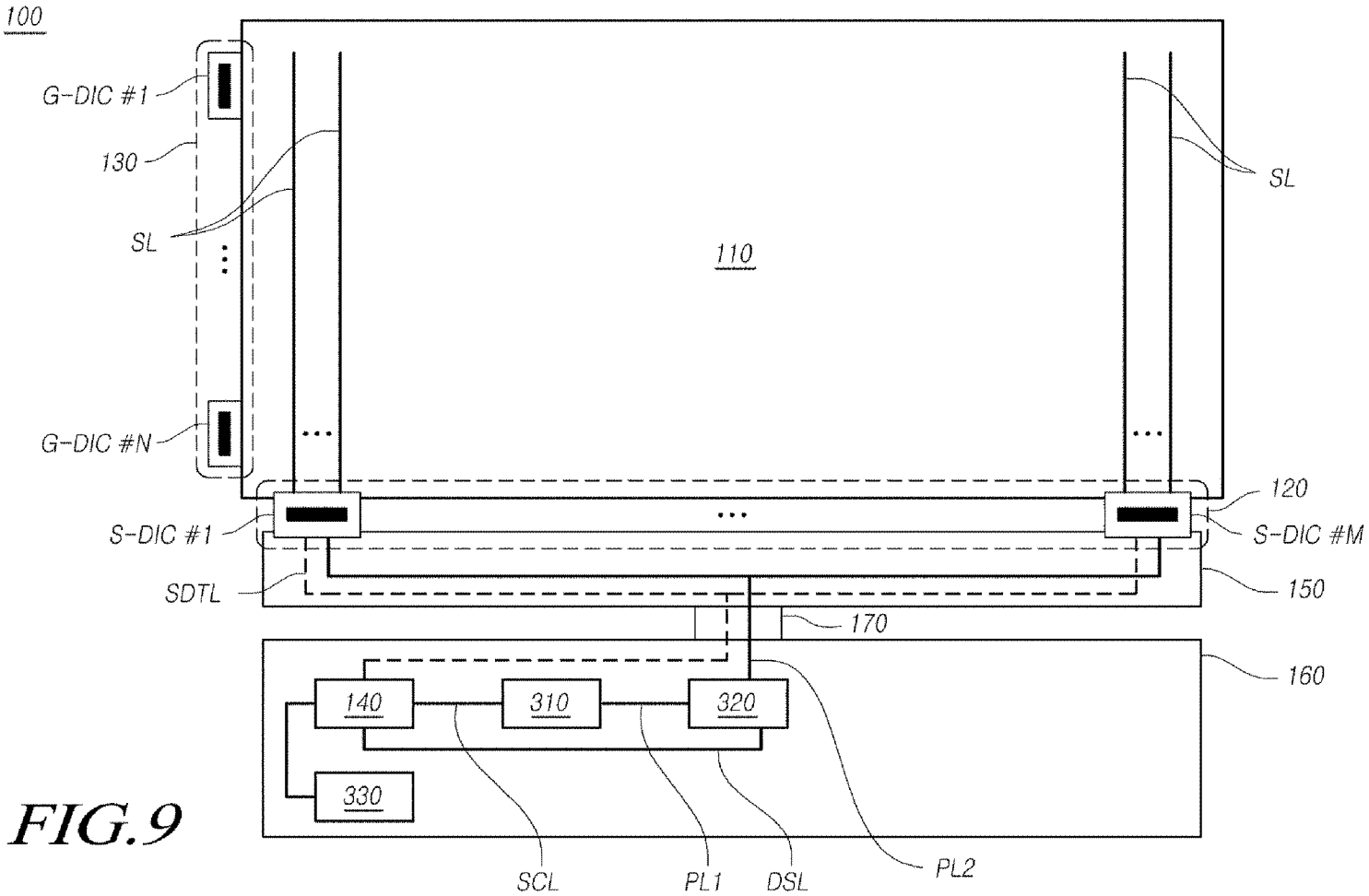
FIG. 9 is an exemplary view implementing a sensing reference power control system in a display device according to embodiments of the present invention.

FIG. 9 is an exemplary view implementing a sensing reference power control system in a display device 100 according to the embodiments of the present invention.

As mentioned above, the analog-to-digital converter 210 which corresponds to the sensing unit may be located in any place of the display device 100, and as an example, the ADC 210 may be included inside each of the source driver integrated circuit (S-DIC). Further, the compensation unit may be located in any place inside the display device 100, however, as an example, the compensation unit may be included inside the timing controller 140.

FIG. 9 is an implementation example of a case where the analog-to-digital converter 210 corresponding to the sensing unit is included inside the source driver IC (S-DIC), and the compensation unit is included in the inside of the timing controller 140.

Referring to FIG. 9, each of M source driver integrated circuits (S-DIC #1, . . . , S-DIC #M) has a built-in analog-to-digital converter 210 and is connected to the timing controller 140 via the sensing data transmission line SDTL. Here, the sensing data transmission line SDTL may be, as an example, a low voltage differential signaling (LVDS) method-based transmission line.

Referring to FIG. 9, a timing controller 140 including a compensation unit may be connected to the power generator 310 via a signal communication line SCL. Here, the signal communication line SCL may be an inter integrated circuit (I2C) protocol-based communication line for accessing the on-board chip or an external memory.

The power generator 310 which is connected with the timing controller 140 via a signal communication line SCL and generates a sensing reference power SRP may be, as an example, a gamma-integrated circuit (Gamma IC).

As described above, it is possible for the power generator 310 to generate the sensing reference power SRP to be implemented by the gamma-integrated circuit corresponding to the existing configuration required for video driving and thus enabling to reduce the number of components.

Referring to FIG. 9, the power generator 310 is connected to a power controller 320 via a first power supply line PL1 and thus may transmit the sensing reference power to the power controller 320.

Further, the power controller 320 is connected to each of M source driver integrated circuits (S-DIC #1, . . . , S-DIC #M) and may transmit the sensing reference power to the analog-to-digital converter 210 incorporated in each of M source driver integrated circuits (S-DIC #1, . . . , S-DIC #M).

The power controller 320 may be connected to the timing controller 140 via a detection signal line DSL. Thus, when the regeneration of the sensing reference power is required, the power controller 320 may transmit the abnormal sensing reference power detection signal ASRPDS to the timing controller 140.

On the other hand, the power controller 320 may be implemented in another single integrated circuit, or it may be implemented as a circuit on a source printed circuit board 160 by using an integrated circuit implementing the comparators 410 and 420 and a Metal Oxide Silicon Field Effect Transistor (MOSFET).

In the following, referring to FIGS. 10 to 13, a description will be given of the block dim phenomenon preventing effect due to the sensing reference power control according to embodiments of the present invention.

Figure 10:
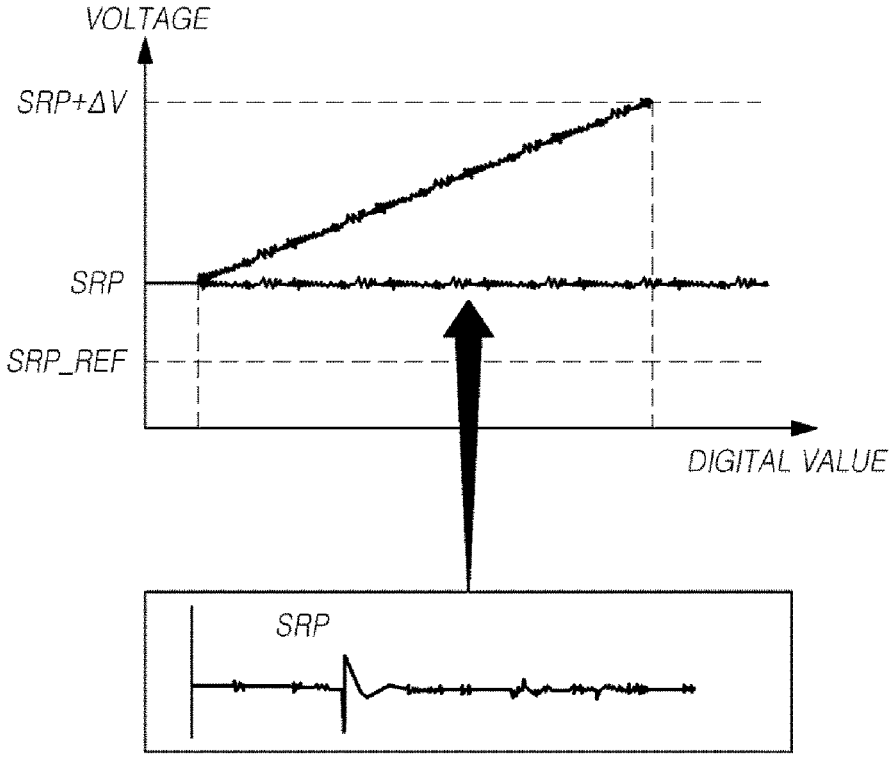
FIG. 10 is a diagram for explaining an abnormal sensing reference power and an error of sensing data when the sensing data is generated using the abnormal sensing reference power.
Figure 11:
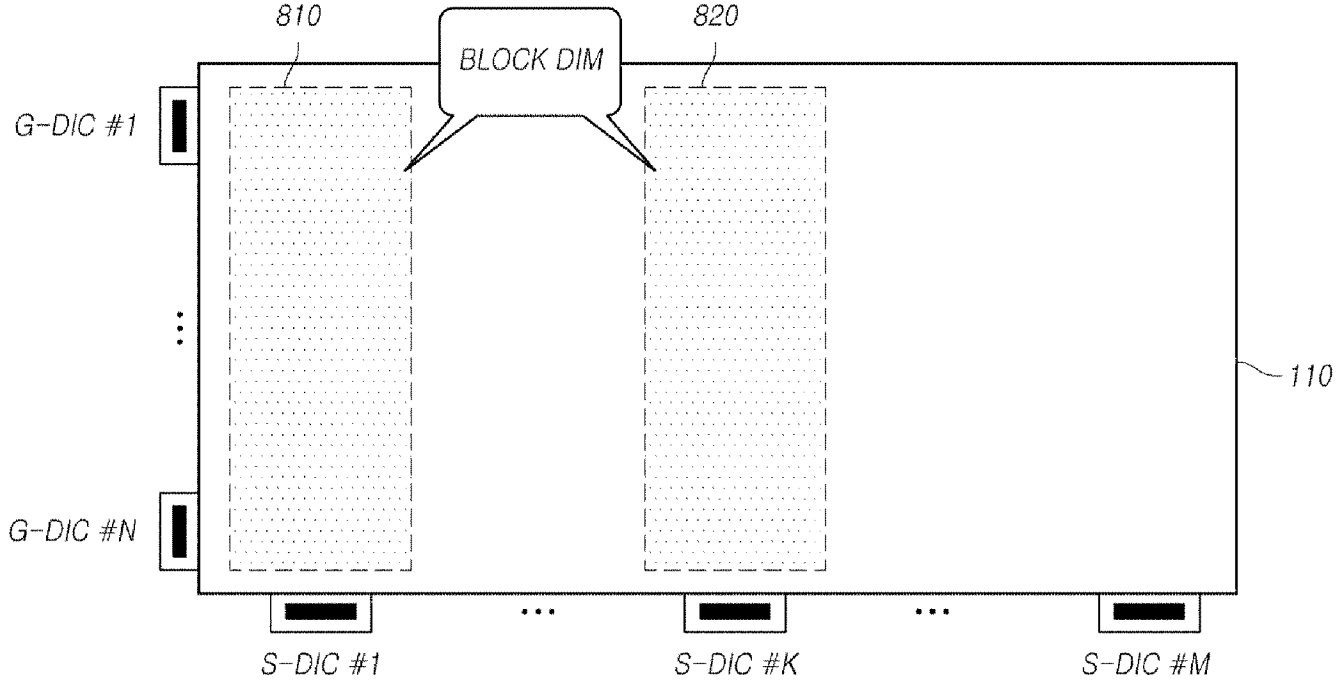
FIG. 11 is a diagram for explaining a block dim phenomenon generated from a display panel when an error occurs in the sensing data due to abnormal sensing reference power.

FIG. 10 is a diagram for explaining an abnormal Sensing Reference Power (SRP) and an error of sensing data generated using the abnormal SRP. FIG. 11 is a diagram for explaining a block dim phenomenon generated from a display panel 110 when an error occurs from the sensing data due to the abnormal sensing reference power SRP.

Referring to FIG. 10, in a case where the sensing reference voltage control according to embodiments of the present invention is not used, when the analog-to-digital converter ADC converts the sensed analog voltage value to a digital value, the sensing reference power SRP serving as a reference can fluctuate. That is, the voltage of the sensing reference power SRP is not fixed to a desired value and may change due to the noise or other signals or the like.

In such a case, when the analog-to-digital converter ADC converts the sensed analog voltage value into a digital value, even the converted digital value is not accurate.

Thus, inaccurate sensing data is generated by the analog-to-digital converter ADC.

Due to the error of the sensing data, the data compensation amount which is calculated by the timing controller 140 corresponding to the compensation unit is also inaccurate, and as a result, the sub-pixel luminance deviation compensation is not properly done and which leads to a poor image quality.

Referring to FIG. 11, the "block dim phenomenon" may occur in regions 810 and 820 corresponding to the columns of the sub-pixel which receives the data voltage from the source driver integrated circuits (in the case of FIG. 11, S-DIC #1 and S-DIC #K) including the analog-to-digital converter ADC which generated the error of the sensing data and thus leads to a poor image quality.

Figure 12:
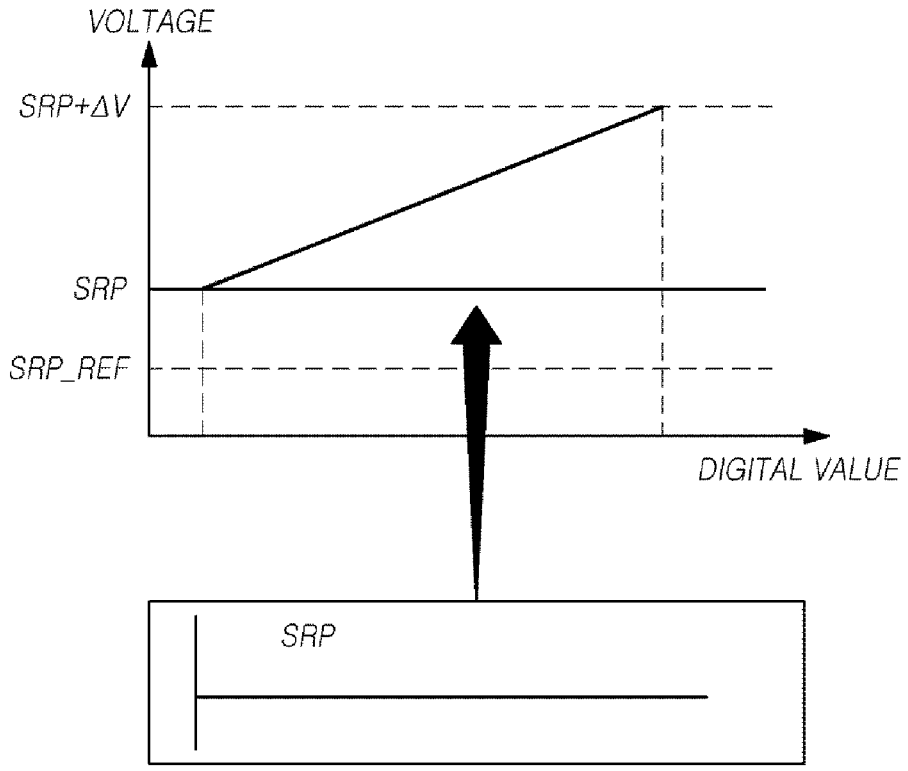
FIG. 12 is a diagram for explaining preventing of occurrence of an error in sensing data when the sensing data is generated using a sensing reference power normally generated by the control of a sensing reference power, according to embodiments of the present invention.
Figure 13:
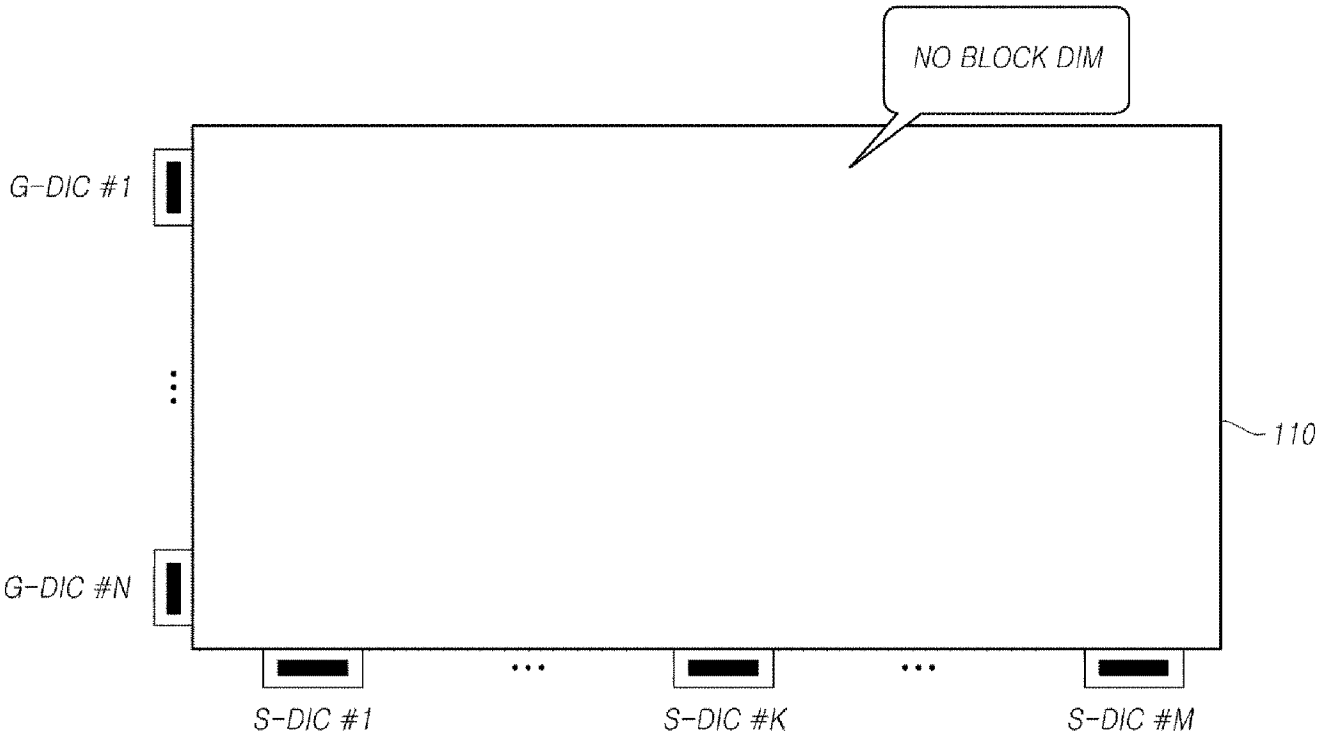
FIG. 13 is a diagram for explaining that when sensing data is generated using a sensing reference power which is normally generated by the control of the sensing reference power according to embodiments of the present invention, an error in the sensing data is prevented and thereby a block dim phenomenon in a display panel is prevented.

FIG. 12 is a diagram for explaining preventing of occurrence of errors in sensing data when generating the sensing data using the sensing reference power SRP which is normally generated by the control of a sensing reference power SRP according to embodiments of the present invention. FIG. 13 is a diagram for explaining that when generating sensing data using the sensing reference power SRP which is normally generated by the control of a sensing reference power SRP according to embodiments of the present invention, an error in the sensing data is prevented and thereby a block dim phenomenon in a display panel is prevented.

Referring to FIG. 12, in a case where a sensing reference voltage control according to embodiments of the present invention is used, when the analog-to-digital converter 210 converts the sensed analog voltage value to a digital value, the sensing reference power SRP serving as a reference can be accurately generated without fluctuation. That is, despite the influence of noise or other signals, the voltage of the sensing reference power SRP is generated at a desired fixed value.

Therefore, the analog-to-digital converter ADC may convert the sensed analog voltage value to an accurate digital value and accurately generate the sensing data that can accurately compensate for the sub-pixel luminance deviation.

Therefore, the timing controller 140 corresponding to the compensation unit can accurately calculate the data compensation amount based on the accurate sensing data. As a result, the sub-pixel luminance deviation compensation is performed appropriately, and as shown in FIG. 13, the poor image quality such as the block dim phenomenon can be prevented.

According to embodiments of the present invention as described above, when generating sensing data serving as a basis for the sub-pixel luminance deviation compensation, since the sensing reference power serving as a reference when converting the sensed analog voltage value into a digital value fluctuates, a problem of a decrease in the unexpected image quality such as a block dim phenomenon along the vertical direction, due to the sub-pixel luminance deviation compensation process, is likely to occur and a solution therefor can be provided.

Further, according to embodiments of the present invention, provide are a display device 100 and a power control device 220 capable of preventing the degradation of image quality that may occur unexpectedly by performing the sub-pixel luminance deviation compensation.

Furthermore, according to embodiments of the present invention, provided are a display device 100 and a power control device 220 capable of acquiring accurate sensing data by exactly generating and providing, as required, sensing reference power serving as a reference when converting analog voltage values sensed at the sub-pixels into digital values and accordingly performing an accurate sub-pixel luminance deviation compensation.

The above description and the accompanying drawings provide an example of the technical idea of the present invention for illustrative purposes only. Those having ordinary knowledge in the technical field, to which the present invention pertains, will appreciate that various modifications and changes in form, such as combination, separation, substitution, and change of a configuration, are possible without departing from the essential features of the present invention. Therefore, the embodiments disclosed in the present invention are intended to illustrate the scope of the technical idea of the present invention, and the scope of the present invention is not limited by the embodiment. The scope of the present invention shall be construed on the basis of the accompanying claims in such a manner that all of the technical ideas included within the scope equivalent to the claims belong to the present invention.

What is claimed is:

1. A display device comprising:

an analog-to-digital converter that receives a sensing reference power, is connected to a sensing line connected to a sensing node within a sub-pixel on a display panel and converts a voltage at the sensing node sensed via a sensing line into a digital value with reference to a voltage of the sensing reference power to output sensing data, wherein the analog-to-digital converter includes a first input to receive the sensing reference power and a second input connected to the sensing line;

a timing controller that is connected to the analog-to-digital converter via a sensing data transmission line, calculates a data compensation amount based on the sensing data input through the sensing data transmission line, and stores the calculated data compensation amount in a memory;

a power generator that generates or regenerates the sensing reference power and then outputs the sensing reference power; and a power controller that receives the sensing reference power from the power generator and outputs the sensing reference power to the analog-to-digital converter or controls the power generator to regenerate the sensing reference power, wherein the power generator generates the sensing reference power and outputs the generated sensing reference power to the power controller when a power generation control signal is input from the timing controller, and the power generator re-generates the sensing reference power and outputs the re-generated sensing reference power to the power controller when a power re-generation control signal is input from the timing controller.

2. The display device of claim 1, wherein the power controller comprises:

a comparator that compares the voltage of the sensing reference power input from the power controller with a predetermined maximum voltage and minimum voltage, respectively; and a determination unit that outputs an abnormal sensing reference power detection signal to the timing controller, depending on a result of the comparison, when the voltage of the sensing reference power input from the power generator exceeds the maximum voltage or is less than the minimum voltage, and outputs the sensing reference power input from the power generator to the analog to digital converter when the voltage of the sensing reference power input from the power generator is greater than or equal to the minimum voltage or is less than or equal to the maximum voltage, wherein the timing controller outputs a power regeneration control signal to the power generator depending on the abnormal sensing reference power detection signal.

3. The display device of claim 1, wherein the power controller or the timing controller outputs a control signal for progressing to a power-off process or a display device reset process when a number of times of an abnormal situation occurrence of the sensing reference power input from the power generator is larger than or equal to a predetermined number.

4. The display device of claim 1, wherein the power controller or the timing controller stops a compensation process when a number of times of an abnormal situation occurrence of the sensing reference power input from the power generator is larger than or equal to a predetermined number.

5. The display device of claim 1, wherein one sensing line is disposed at every sub-pixel column or a pixel column, and the analog-to-digital converter is connected to one or more sensing lines and is included in a source driver integrated circuit.

6. The display device of claim 1, wherein the power generator is a gamma integrated circuit which is connected to the timing controller via a serial communication line.

7. The display device of claim 1, wherein the voltage sensed by the analog-to-digital converter via the sensing line is for identifying a unique characteristic value or a change of the unique characteristic value of a driving transistor or an organic light emitting diode within the sub-pixel.

8. A power control device comprising:

a power generator that generates and outputs a sensing reference power which serves as a reference for an analog-to-digital converter that receives the sensing reference power and converts a voltage at a sensing node within a sub-pixel on a display panel into a digital value, wherein the analog-to-digital converter includes a first input to receive the sensing reference power and a second input to receive the voltage at the sensing node; and a power controller that outputs a sensing reference power to the analog to digital converter when the voltage of the sensing reference power input from the power generator is within a predetermined voltage range, and controls the power generator to regenerate the sensing reference power when the voltage of the sensing reference power input from the power generator is out of the predetermined voltage range, wherein the power generator generates the sensing reference power and outputs the generated sensing reference power to the power controller when a power generation control signal is input from a timing controller, and re-generates the sensing reference power and outputs the re-generated sensing reference power to the power controller when a power re-generation control signal is input from the timing controller, wherein the power controller comprises:

a comparator that compares the voltage of the sensing reference power input from the power generator with a predetermined maximum voltage and minimum voltage, respectively; and a determination unit that outputs an abnormal sensing reference power detection signal to the timing controller, depending on a result of the comparison, when the voltage of the sensing reference power input from the power generator exceeds the maximum voltage or is less than the minimum voltage, and outputs the sensing reference power input from the power generator to the analog to digital converter when the voltage of the sensing reference power input from the power generator is greater than or equal to the minimum voltage or less than or equal to the maximum voltage.

9. The display device of claim 1, wherein the analog-to-digital converter directly receives the sensing reference power.

* * * * *